US005507550A

United States Patent [19]

Maloney

[11] Patent Number: 5,507,550

[45] Date of Patent: Apr. 16, 1996

[54] HIGHCHAIR

[75] Inventor: Kevin V. Maloney, North Kingstown, R.I.

[73] Assignee: Hasbro, Inc., Pawtucket, R.I.

[21] Appl. No.: 254,799

[22] Filed: Jun. 6, 1994

[51] Int. Cl.[6] ..... A47B 83/02

[52] U.S. Cl. ..... 297/153; 297/149; 297/188.04; 297/467; 297/344.14; 297/344.18; 297/327

[58] Field of Search ..... 297/135, 148, 297/149, 151, 153, 174, 188.04, 325–327, 344.1, 344.12, 344.14, 250.1, 464, 467, 344.18, 328, 463.1; 108/137, 54

[56] References Cited

U.S. PATENT DOCUMENTS

| | | | |
|---|---|---|---|
| D. 138,067 | 6/1944 | Morando . | |
| D. 147,540 | 9/1947 | Engelberg et al. . | |
| D. 148,068 | 12/1947 | Huber . | |
| D. 177,231 | 3/1956 | Hail et al. . | |
| D. 181,975 | 1/1958 | Hail et al. . | |
| D. 246,682 | 12/1977 | Nakao . | |
| D. 278,483 | 4/1985 | Takada . | |
| 284,671 | 9/1883 | Reed . | |
| D. 290,429 | 6/1987 | Lemmeyer . | |
| D. 291,156 | 8/1987 | Nakao et al. . | |
| D. 297,684 | 9/1988 | Taylor, Sr. . | |
| 373,296 | 11/1887 | Mann et al. . | |
| 628,166 | 7/1899 | Sheridan | 297/344.12 X |
| 930,074 | 8/1909 | Jaspersen . | |
| 1,967,096 | 7/1934 | McCoy | 297/197 |
| 2,362,465 | 11/1944 | Carner . | |
| 2,532,812 | 12/1950 | Huber | 297/149 |
| 2,562,629 | 7/1951 | Miles | 297/153 X |
| 2,731,072 | 1/1956 | Post . | |
| 2,790,484 | 4/1957 | Pollack . | |
| 2,984,291 | 5/1961 | Kostenborder et al. . | |
| 3,131,968 | 5/1964 | Alt | 297/188.04 X |
| 3,649,074 | 3/1972 | McDonald et al. . | |
| 4,065,177 | 12/1977 | Hyde et al. . | |
| 4,072,318 | 2/1978 | Laune . | |
| 4,082,349 | 4/1978 | Ballenger . | |
| 4,105,247 | 8/1978 | Saint . | |
| 4,288,123 | 9/1981 | Cone . | |
| 4,561,621 | 12/1985 | Hill . | |
| 4,582,359 | 4/1986 | Wise et al. . | |
| 4,606,576 | 8/1986 | Jones . | |
| 4,632,456 | 12/1986 | Kassai . | |
| 4,722,570 | 2/1988 | Bertoli | 297/153 X |
| 4,723,813 | 2/1988 | Kassai | 297/153 |
| 4,744,599 | 5/1988 | Jankowski et al. . | |
| 4,807,928 | 2/1989 | Cone . | |
| 4,818,016 | 4/1989 | Mariol et al. . | |
| 4,819,988 | 4/1989 | Hellstrom | 297/467 |
| 4,842,331 | 6/1989 | Waples . | |
| 4,938,603 | 7/1990 | Turner et al. . | |
| 4,962,965 | 10/1990 | Glover . | |
| 4,971,389 | 11/1990 | Staggs et al. . | |
| 5,087,097 | 2/1992 | Hehn . | |
| 5,118,161 | 6/1992 | Slowe et al. . | |

(List continued on next page.)

FOREIGN PATENT DOCUMENTS

| | | | |
|---|---|---|---|
| 4106 | of 1890 | United Kingdom | 297/344.12 |
| 464806 | 4/1937 | United Kingdom | 297/149 |

OTHER PUBLICATIONS

Marshall Baby Products 1993 Catalog; p. 18.

*Primary Examiner*—Milton Nelson, Jr.
*Attorney, Agent, or Firm*—Kurt R. Benson

[57] ABSTRACT

A highchair for an infant or toddler includes a seat element, a frame assembly for supporting the seat element on a supporting surface, and a feeding tray assembly on the seat element. The feeding tray assembly includes a center support and retaining post which is secured to the front center portion of the seat element and a tray element which is adjustably secured to the upper end of the center support and retaining post. The center support and retaining post is operative for preventing a child from sliding downwardly between the seat element and the tray element regardless of the adjusted position of the tray element, and the seat element is secured to the frame assembly so that it is both vertically adjustable and reclinable.

16 Claims, 7 Drawing Sheets

U.S. PATENT DOCUMENTS 5,141,286 8/1992 Ayala, Jr. et al. .
5,195,770 3/1993 Ishikura .
5,238,292 8/1993 Golenz et al. .
5,249,838 10/1993 Kulpa et al. .
5,332,241 7/1994 Rho ..... 297/344.14
5,348,374 9/1994 Kuo ..... 297/153 X
5,364,137 11/1994 Shimer ..... 297/327

HIGHCHAIR

BACKGROUND AND SUMMARY OF THE INVENTION

The instant invention relates to juvenile furniture and more particularly to a highchair which is adapted to be adjusted between a normal seating position and a reclined position and which is adapted to effectively retain an infant or toddler in a seated position therein during a feeding operation.

A wide variety of different types of highchairs and the like have been heretofore available for supporting infants and toddlers in upright or seated positions. Further, many of the heretofore available highchairs have been adapted to include feeding trays or the like which function to support feeding dishes and other articles so that they are positioned in front of infants and toddlers during feeding operations. For the most part, the feeding trays of the heretofore available highchairs have been removably attached to side or armrest portions of highchairs. However, it has been found that when the feeding trays of highchairs are mounted on the armrest portions thereof, it is possible for infants and toddlers to slide down between the seat portions and feeding trays of highchairs and that, in some instances, this can result in serious injury to infants and toddlers. Further, while some of the heretofore available highchairs have included feeding trays which are mounted on center support posts, which inherently function to restrict the downward movement of infants and toddlers between the seat portions of highchairs and the feeding trays thereof, the few highchairs which have included center support posts have not been adapted to permit adjustment of the positions of feeding trays while also providing effective retaining means which prevent infants and toddlers from sliding downwardly between the trays and seat portions thereof. Further, while some of the heretofore available highchairs have included reclinable seat portions, for the most part the heretofore available highchairs have not included safe and efficient mechanisms for achieving reclinability.

The instant invention provides an effective and unique highchair which includes a feeding tray and which is adapted to effectively retain an infant or toddler in a seat element portion thereof during a feeding operation as well as during other times when the feeding tray is assembled on the seat element. More specifically, the instant invention provides a highchair comprising a seat element which is adapted for receiving and supporting an infant or toddler in a seated position therein, and which includes connected seat and backrest portions and a pair of side armrest portions which extend along opposite sides of the seat portion. The highchair further includes a frame assembly for supporting the seat element in upwardly spaced relation to a supporting surface and a tray assembly which is removably and adjustably secured to the seat element. The tray assembly includes a center support and retaining post which is adapted to be removably secured to the seat portion of the seat element at a central location adjacent the front extremity thereof. The tray assembly further includes a tray element which is adapted to be adjustably secured to the support and retaining post in a manner which allows the position of the tray element to be forwardly and rearwardly adjusted in substantially parallel upwardly spaced relation to the seat portion of the seat element while the support and retaining post remains in substantially stationary relation to the seat element. As a result, the position of the tray element can be effectively adjusted relative to the seat element, but the support and retaining post to which the tray element is attached remains stationary relative to the seat element and a child received therein as the position of the tray element is adjusted. Accordingly, the ability of the support post to effectively retain an infant or toddler in a seated position in the seat element is not effected as the position of the tray element is adjusted. The highchair preferably includes a latch assembly on the tray element which is engageable with the upper end of the center support and retaining post for releasably securing the tray element in a plurality of different adjusted positions on the support post. Further, the latch assembly preferably includes a forward handle portion which is movable upwardly toward the tray element for disengaging the latch arm from the support and retaining post. Further, the armrest portions of the seat element preferably have upwardly facing support surfaces thereon, and the highchair is preferably constructed so that the tray element slides on the upper support surfaces of the armrest portions during adjustment of the tray element in forward or rearward directions. Still further, the armrests portions of the chair element preferably have outwardly extending retaining elements thereon, and the tray element preferably has a pair of hook elements thereon which slidably engage the retaining elements for retaining the tray element in engagement on the upper support surfaces of the armrest portions while the position of the tray element is adjusted in either forward or rearward directions.

In addition, because of the way in which the seat element of the highchair of the subject invention is mounted on the frame assembly, the seat element is both vertically adjustable and reclineable. Specifically, because the seat element is mounted on the frame with a carriage assembly, the seat element is vertically adjustable with the carriage assembly, and because the seat element is pivotally attached to a pair of pivot arms on the carriage assembly, the seat element can be pivoted to a reclined position regardless of the vertical position of the seat element relative to the frame.

Accordingly, it is the primary object of the instant invention to provide an improved highchair comprising a tray assembly which is operative for retaining an infant in a seated position on the highchair.

Another object of the instant invention is to provide a highchair which includes a center support and retaining post for mounting a feeding tray portion on a seat element wherein the position of the feeding tray is adjustable without adjusting the position of the support and retaining post relative to the seat element.

An even still further object of the instant invention is to provide a highchair which includes a seat element, a center support and retaining post mounted in a central location adjacent the forward edge of the seat element, and a feeding tray which is adjustably secured to the upper extremity of the support and retaining post.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
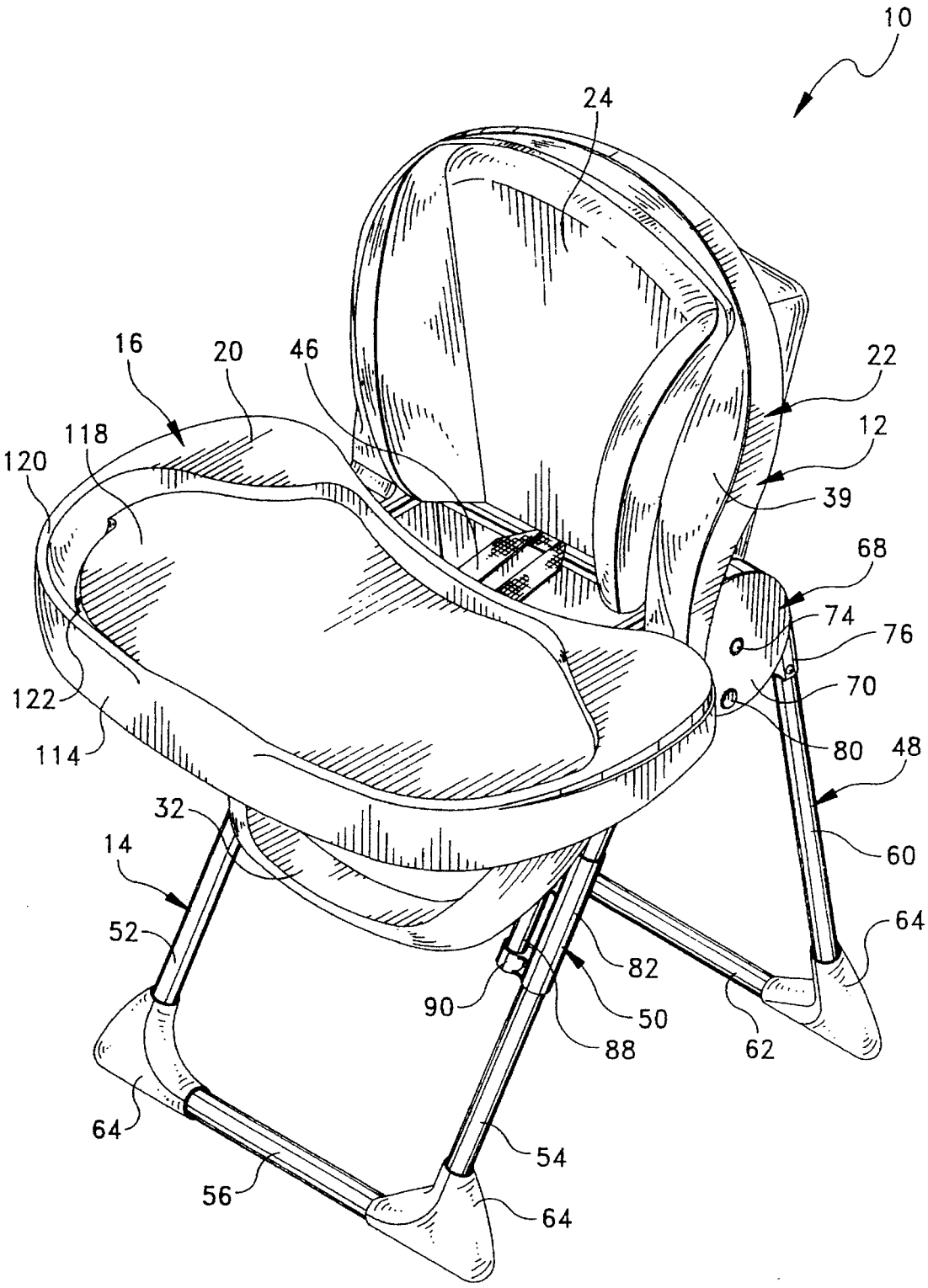
FIG. 1 is a perspective view of the highchair of the instant invention.
Figure 11:
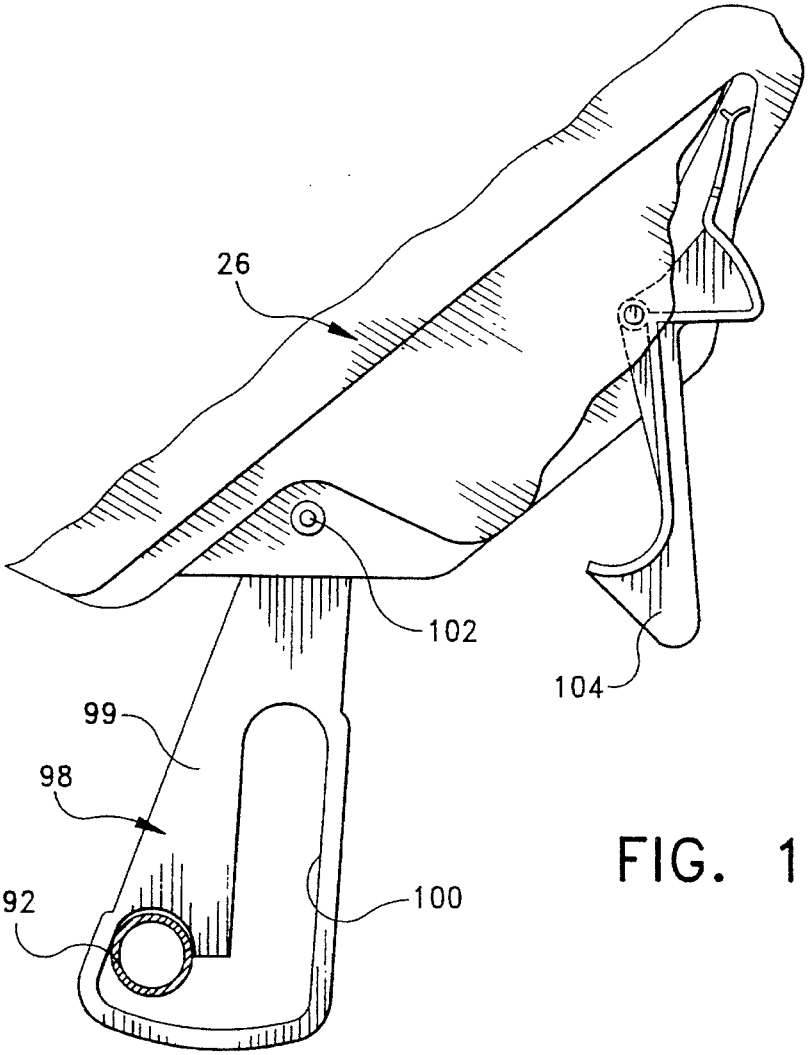
FIG. 11 is a similar view with the seat element in a reclined position.
Figure 12:
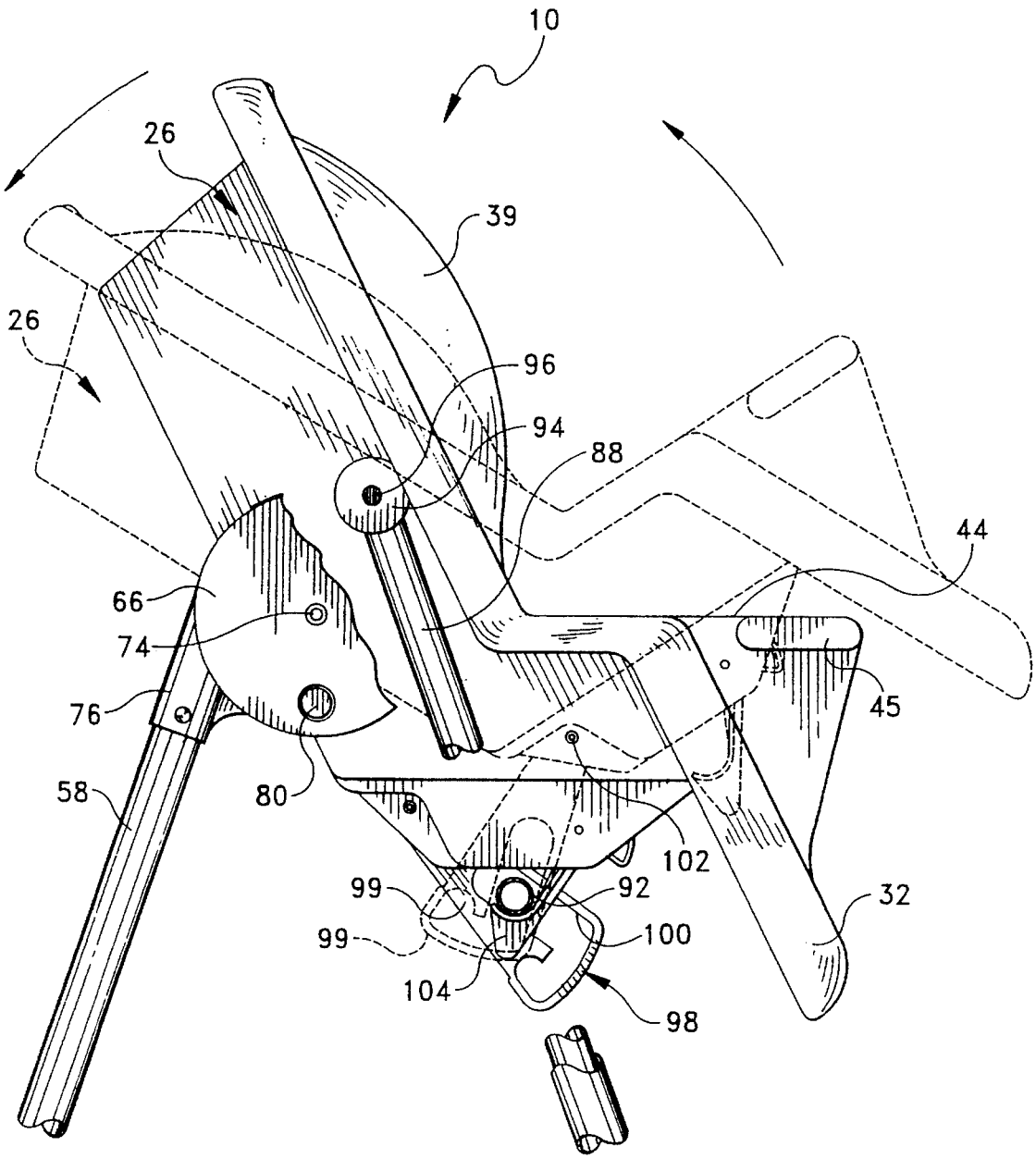
FIG. 12 is a fragmentary side elevational view of the highchair as the seat element is moved from the upright position thereof to the reclined position thereof.

Referring now to the drawings, the highchair of the instant invention is illustrated and generally indicated at 10 in FIGS. 1, 11 and 12. The highchair 10 comprises a seat element generally indicated at 12, a frame assembly generally indicated at 14, and a tray assembly generally indicated at 16. The highchair 10 is adapted so that the seat element 12 is vertically adjustable on the frame assembly 14 and pivotable rearwardly thereon to the reclined position illustrated in FIGS. 12 and 13. The tray assembly 16 is mounted on the seat element 12, and it includes a center support and retaining post generally indicated at 18 and a tray element 20. The center support and retaining post 18 is removably secured to the seat element 12, and it is positioned in a central location adjacent the front edge of a lower seat portion of the seat element 12. Accordingly, the center support and retaining post 18 is operative for retaining a child in the seat element 12 so that the child does not slide downwardly therefrom off the front edge of the seat element 12. The tray element 20 is adjustably secured to the upper end of the center support and retaining post 18 so that the position of the tray element 20 is adjustable in forward and rearward directions without altering the position of the center support and retaining post 18. Accordingly, the center support and retaining post 18 is effectively operative for retaining a child in a seated position in the seat element 12, regardless of the position of the tray element 20 relative to the seat element 12.

The seat element 12 includes a main seat portion generally indicated at 22 which is preferably integrally molded from a suitable plastic material and a cushion portion 24. As illustrated most clearly in FIG. 2, the main portion 22 comprises integrally connected backrest and seat portions generally indicated at 26 and 28, respectively, a pair of side armrest portions 30, and a footrest portion 32. The backrest portion 26 is formed so as to include a rearwardly opening compartment 34 for temporarily storing various articles, such as a bib, a feeding bottle and/or feeding utensils. The backrest portion 26 includes a main or upper front surface portion 36 and a lower front surface portion 38 which cooperate to define a generally planar backrest surface, and a pair of wings 39 extend forwardly along opposite sides of the backrest portion 26. The seat portion 28 extends integrally forwardly from the backrest portion 26 terminating in a forward extremity or edge 40, and a receiving block 42 is integrally formed in the seat portion 28 for receiving the support and retaining post 18 on the seat portion 28. The armrest portions 30 extend integrally upwardly along opposite side extremities of the seat portion 28 terminating in upper surfaces 44, and they include outwardly extending retaining portions 45. The footrest portion 32 extends downwardly from the seat portion 28 as illustrated most clearly in FIG. 2, and a harness or strap assembly 46 extends forwardly from the backrest portion 26 for securing an infant or toddler in the chair 10. The cushion portion 24 is dimensioned and configured to be received on the seat element 12 so that it substantially covers the back and seat portions 26 and 28, respectively, as illustrated in FIG. 1.

The frame assembly 14 comprises a leg frame portion generally indicated at 48 and a carriage portion generally indicated at 50. The leg frame portion 48 comprises left and right front legs 52 and 54, respectively, having spaced apertures 55 in the rear sides thereof. The front legs 52 and 54 are joined by a cross member 56, and the frame assembly 14 further includes left and right rear legs 58 and 60 which are joined by a cross member 62. Stability members 64 are provided on the bottom ends of the left and right legs 52 and 54 respectively where they meet the cross member 56, and stability members 64 are similarly received on the left and right rear legs 58 and 60 where they join the cross member 62. The front and rear left legs 52 and 58 are pivotally joined at the upper ends thereof through a left upper pivot member 66, and the front and rear right legs 54 and 60, respectively, are pivotally joined at the upper ends thereof through a right upper pivot member 68. Accordingly, when the chair 10 is in the erected position thereof illustrated in FIG. 1, the front legs 52 and 54 converge with their respective rear legs 58 and 60.

Figure 2:
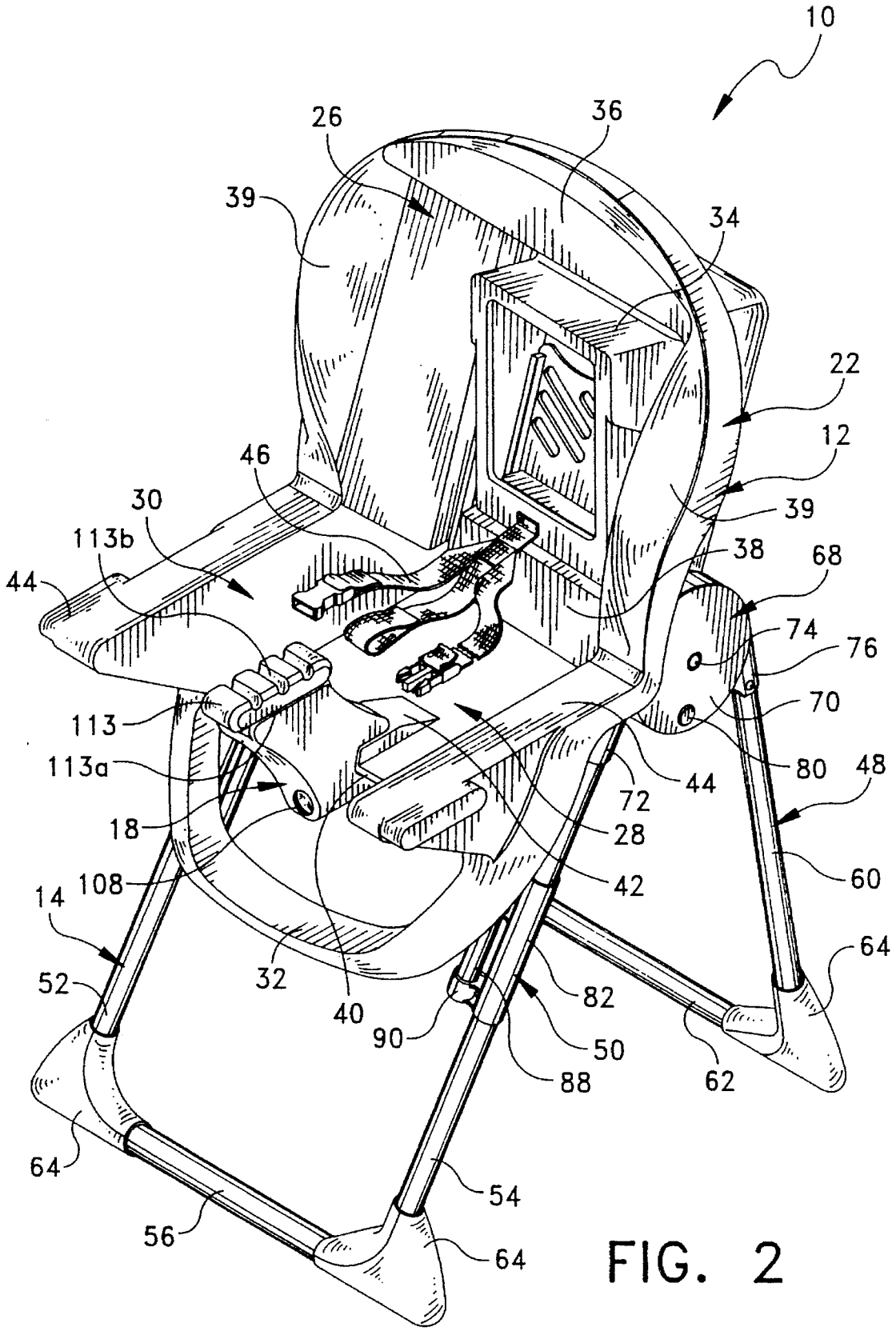
FIG. 2 is a similar perspective view with the cushion and feeding tray removed.
Figure 3:
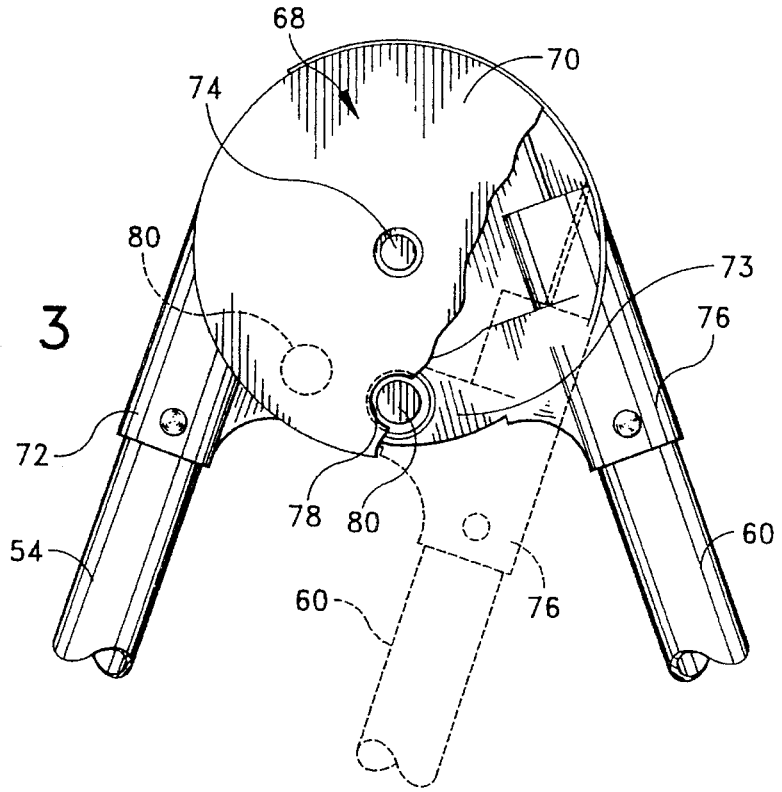
FIG. 3 is a fragmentary side elevational view of the upper pivot joint on the right side of the frame.
Figure 4:
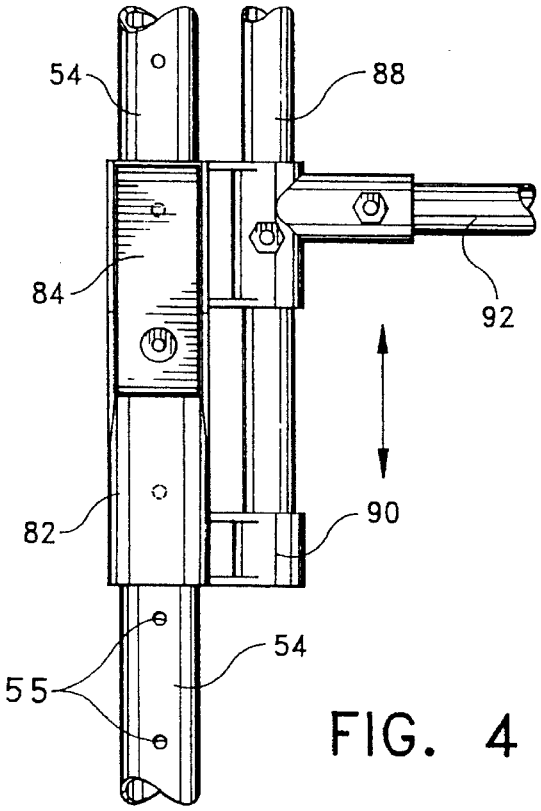
FIG. 4 is a rear view of the lower right portion of the carriage assembly.

Referring now to FIG. 3, the right upper pivot member 68 is illustrated, it being understood that the left side upper pivot member 66 is essentially identical in construction to the pivot member 68 but a mirror image thereof. The right upper pivot member 68 comprises a main housing portion 70 having a front leg socket 72 formed therein and a rear or pivoting portion 73, which is pivotally joined to the main housing portion 70 with a pivot pin 74. The pivot portion 73 has a rear leg socket 76 formed therein for receiving the rear leg 60, and it is adapted to pivot relative to the main housing portion 70 about the axis of the pivot pin 74 for collapsing the leg portion 48 of the frame assembly 14. The main housing portion 70 has an aperture 78 formed therein; and a spring loaded button 80, which is mounted in the pivot portion 73, is receivable in the aperture 78 for releasably securing the pivot member 68 in an operative position in which the legs 54 and 60 are retained in the erected positions thereof illustrated in FIGS. 1 and 2. As illustrated in FIG. 3, by depressing the button 80 the rear leg 60 can be pivoted toward the front leg 54 in order to collapse the right half of the leg portion 48.

Figure 5:
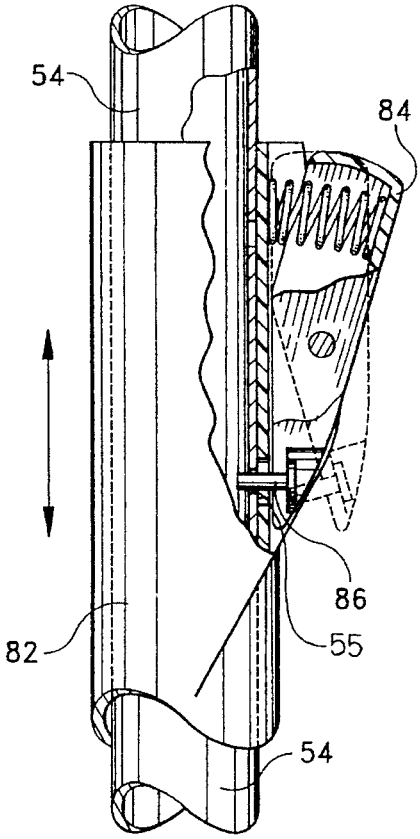
FIG. 5 is an enlarged side elevational view thereof shown in partial section.
Figure 13:
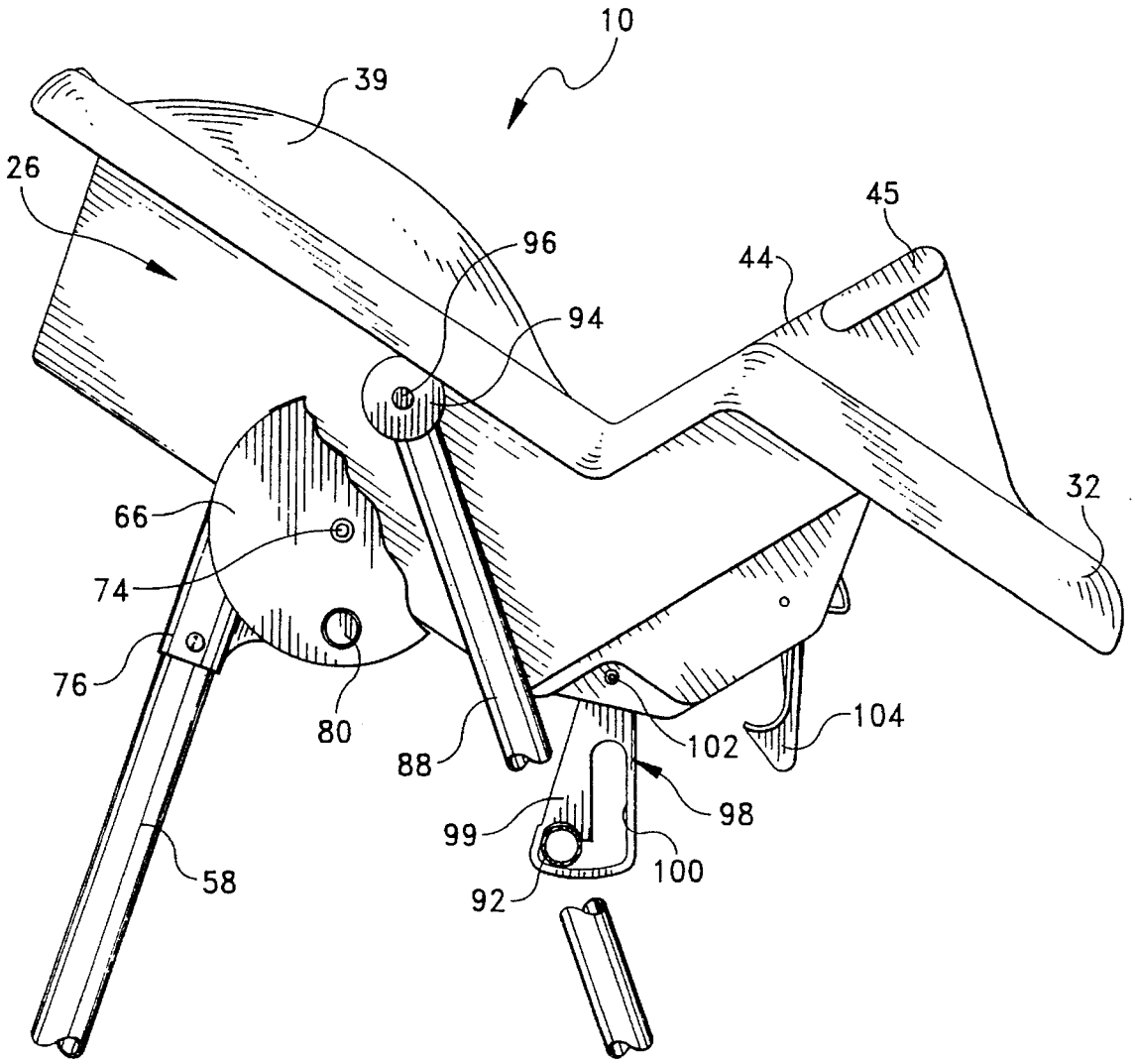
FIG. 13 is a similar view with the seat element in the reclined position thereof.

The carriage portion 50 is operative for mounting the seat portion 12 on the frame assembly 14 so that the seat portion 12 is vertically adjustable relative to the leg frame portion 48 and so that the seat portion 12 is also rearwardly pivotable to the reclined position thereof illustrated in FIGS. 12 and 13. The carriage portion 50 comprises a pair of sleeve elements 82 which are slidably received on the front legs 52 and 54, respectively. Attached to the sleeve elements 82 are spring loaded latch members 84 having latching pins 86 thereon. As illustrated in FIG. 5, the latch members 84 are operative for securing the positions of the sleeves 82 relative to the legs 52 and 54 by passing the pins 86 into the apertures 55 on the rear sides of the legs 52 and 54. The carriage assembly 50 further comprises a pair of support arms 88 which are attached to the sleeves 82 with tubular connectors 90 which are integrally formed with the sleeves 82. The support arms 88 extend angularly upwardly and rearwardly in substantially parallel relation to the legs 52 and 54, and a crossbar 92 extends therebetween. The support arms 88 extend upwardly in spaced, substantially parallel relation terminating in pivot ends 94 which are pivotally connected to opposite sides of the backrest portion 26 with pivot pins 96.

Figure 9:
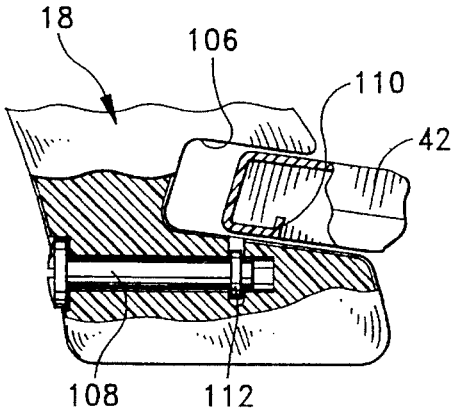
FIG. 9 is a similar view with the center support and retaining post in an unlocked partially removed position.
Figure 10:
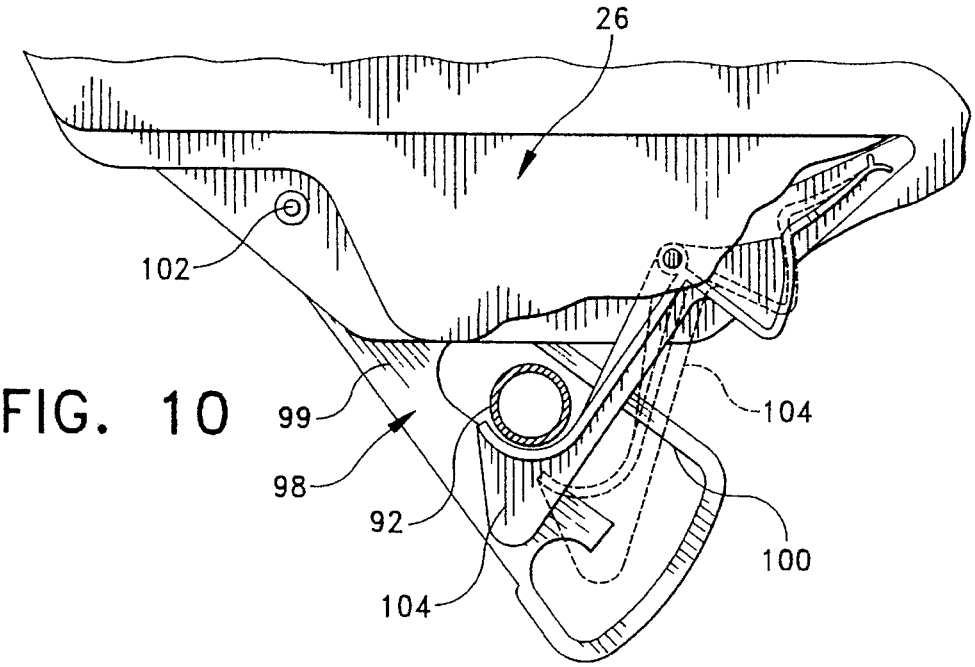
FIG. 10 is a fragmentary side elevational view of the seat element pivot mechanism with the seat element in a seating position.

Also included in the carriage assembly 50 is a retainer bracket 98 which is illustrated most clearly in FIGS. 9 through 12. The retainer bracket 98 includes a pair of spaced walls 99 having J-shaped openings 100 formed therein. The bracket 98 is pivotally attached to the seat portion 28 at 102, and the crossbar at 92 is received in the openings 100. As a result, as illustrated in FIGS. 11 and 12, the bracket 98 can be repositioned relative to the crossbar 92 for alternatively securing the seat element 12 in the seating or upright position thereof illustrated in FIGS. 1 and 2, or the reclined position thereof illustrated in FIG. 12. Also, as illustrated in FIGS. 9, 10 and 12, the carriage assembly 50 further includes a latch member 104 which is engageable with the crossbar 92 for releasably retaining the seat portion 12 in the upright seating position thereof.

Figure 6:
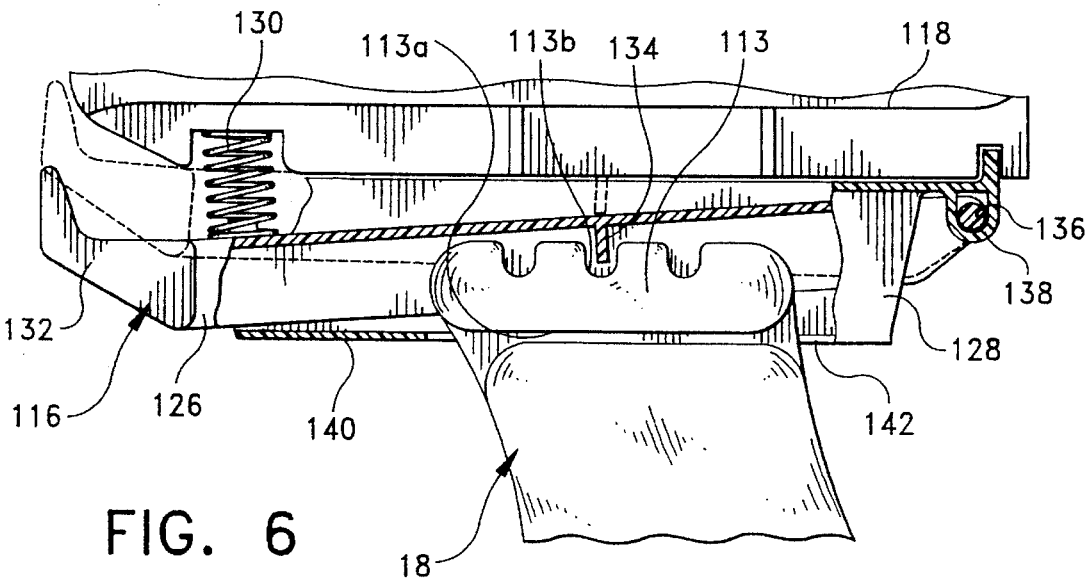
FIG. 6 is a fragmentary side elevational view of the upper portion of the center support and retaining post and the tray element.
Figure 7:
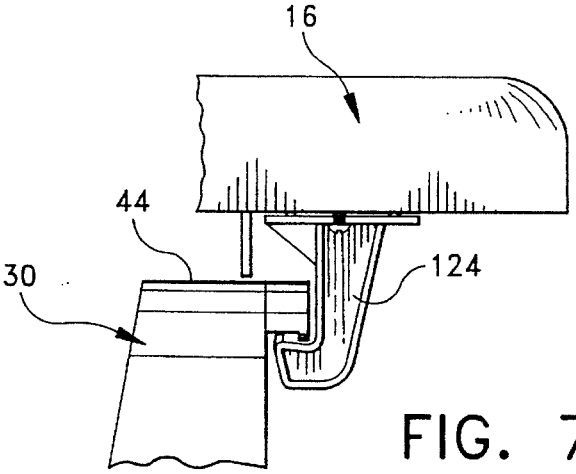
FIG. 7 is a fragmentary front elevational view of the right side armrest and the adjacent portions of the tray element.
Figure 8:
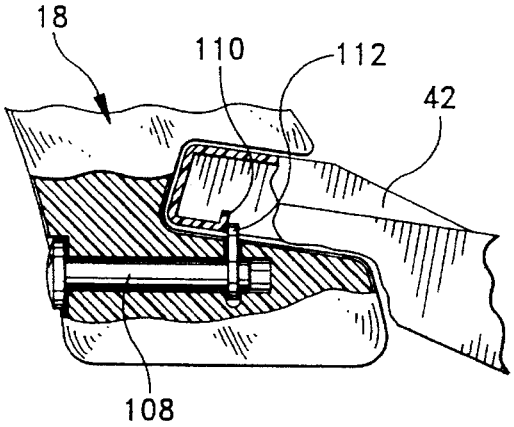
FIG. 8 is a fragmentary sectional view of the lower portion of the center support and retaining post in a locked position on the seat element.

Referring now to FIGS. 1, 2 and 6 through 8, the tray assembly 16 and the manner in which it is attached to the seat 12 with the center support and retaining post 18 is illustrated. As illustrated, the center support and retaining post 18 has a rearwardly opening slot 106 formed therein adjacent the lower end thereof. The slot 106 is adapted and dimensioned for receiving the receiving block 42 therein, and a locking screw 108 is provided for releasably securing the post 18 to the seat portion 28 so that the receiving block 42 is received in the slot 106. In this regard, as illustrated in FIGS. 7 and 8, the receiving block 42 has an opening 110 formed in the underside thereof, and the locking screw 108 has a locking element 112 formed thereon which is rotatable to a position of engagement with the receiving block 42 in the opening 110 in order to secure the post 18 on the receiving block 42 as illustrated in FIG. 8. As illustrated in FIG. 2, when the post 18 is received in assembled relation with the seat portion 28 in this manner, it is substantially equally spaced between the armrest portions 30. As further illustrated, the support and retaining post 18 has an enlarged upper end 113 having a track **113*a* along the lower edge thereof and having a plurality of notches 13*b*** in the upper side thereof.

The tray element 16 further includes a tray portion 114 and a latch arm assembly generally indicated at 116. The tray portion 114 includes a center tray area 118 which is surrounded by a raised rim portion 120 and a slightly recessed spill channel area 122 extends around a portion of the central tray area 118. As illustrated in FIG. 7, the tray portion 114 further includes a pair of hook elements 124 which extend downwardly from the central tray area 118 for engaging the retaining portions 45 of the armrests 30 to retain the tray element 16 in engagement therewith. As will be seen, the tray element 16 and the armrests 30 are constructed so that the tray element 16 slides on the substantially fiat upper surfaces 44 of the armrests 30 as the position of the tray element 16 is adjusted relative to the seat element 12.

The latch arm assembly 116 is illustrated most clearly in FIG. 6. The latch arm assembly 116 includes an elongated latch arm member 126, a latch arm housing 128, and a latch arm spring 130. The latch arm 126 has a handle portion 132 formed at one end thereof, and an elongated transversely downwardly extending tooth 134 is formed at an intermediate point in the extent of the latch arm 126. The latch arm 126 includes a pivot pin portion 136 at the end thereof opposite from the handle portion 132, and the pivot pin portion 136 is received in a pair of correspondingly formed pivot mounts 138 in the housing 128. The housing 128 is of elongated configuration, and it is mounted on the underside of the table portion 118. The housing 128 is dimensioned and configured for retaining the latch arm 126 in a position adjacent the underside of the tray portion 114 which nevertheless permits the latch arm 126 to be pivoted upwardly against the force of the spring 130. The housing 128 includes a bottom wall 140 having an elongated opening 142 formed therein. The opening 142 is dimensioned for receiving the post 18 in the housing 128 so that opposing portions of the bottom wall 140 are received in the track **113*a*, and so that the upper end portion 113 of the post 18 is received in the interior of the housing 128 in the manner illustrated in FIG. 6. As will be seen, when the upper end portion 113 is received in the housing 128 in this manner, the elongated transversely-extending tooth 134 is receivable in a selected one of the notches 113*b* for securing the position of the tray 16 on the upper end portion of the post 18**.

Accordingly, for use and operation of the high chair 10, an infant or toddler is placed in the seat portion 12 so that the infant's or toddler's legs straddle the center support and retaining post 18. The feeding tray 16 may be assembled with the center support and retaining post 18 in the manner illustrated in FIG. 6 either before or after placing an infant or toddler in the seat portion 12. Specifically, by lifting upwardly on the handle portion 132 and placing the tray element 16 so that it rests on the armrests 30, the tray element 16 can be advanced rearwardly so that the hook elements 124 are received in engagement with the retaining elements 45 on the armrests 30. By further advancing the tray 16 rearwardly, it can be adjustably secured in a selected position on the post 18 by allowing the tooth 134 to be received in one of the notches **113*b*. Once the tray 16 has been positioned on the post 18 in this manner, it is effectively retained in position on the seat 12 by the cooperative engagement of the latch arm assembly 116 with the post 18 and the engagement of the hook elements 124 with the armrest portions 30. Accordingly, the tray 16 can then be effectively utilized as a table surface during a feeding operation for the child or simply as an effective platform surface which is conveniently accessible to the child. In either case, the center support and retaining post 18 functions as an effective retaining member which prevents the child from sliding downwardly on the seat 12 between the seat portion 28 and the feeding tray 16. As a result, the center support and retaining post 18 provides an effective safety feature which minimizes the risk of injury to the child during use of the highchair 10**.

Still further, as illustrated in FIGS. 12 and 13, the highchair 10 is also operative without the tray 16 as a reclinable seat for a child. In this regard, the seat 12 is adapted to pivot as a single unit between the upright seated position illustrated in FIG. 1 and the fully reclined position illustrated in FIG. 13. Specifically, by simply releasing the latch member 104 and pivoting the chair element 12 rearwardly, the crossbar 92 can be repositioned in the opening 100 to retain the highchair 10 in the reclined position. Still further, because the seat 12 is mounted on the carriage assembly 50, the vertical position of the chair element 12 can be readily and easily adjusted on the frame portion 48, regardless of whether the chair 12 is in the upright position thereof or the reclined position thereof.

It is seen, therefore, that the instant invention provides an effective highchair which has significant advantages over the heretofore available highchair products. Specifically, the tray assembly 16 is adapted to be supported on the center support and retaining post 18 to provide both an effective support for the tray assembly 16 and to provide an effective retaining means for retaining a child in the seat 12. Further, the seat 12 is adapted to be moved to a reclined position, and it is vertically adjustable regardless of whether it is in a reclined position or an upright position. Hence, it is seen that the chair of the instant invention represents a significant advancement in the art relating to juvenile furniture which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is chimed is:

1. A highchair comprising:

a seat element for receiving and supporting an infant or toddler in a seated position therein, said seat element including seat and backrest portions, said seat portion having a front extremity, and a pair of opposite side armrest portions extending upwardly along opposite sides of said seat portion;

frame means for supporting said seat element in upwardly spaced relation to a supporting surface; and a tray assembly removably and adjustably secured to said seat element, said tray assembly comprising a center support and retaining post having an upper end, means for securing said center support and retaining post to said seat portion adjacent the front extremity thereof at a location which is substantially equally spaced between said armrest portions, a tray element and means for adjustably securing said tray element to said center support and retaining post adjacent to the upper end thereof such that the position of said tray element is forwardly and rearwardly adjustable in substantially parallel upwardly spaced relation to said seat portion while said support and retaining post remains in substantially stationary relation to said seat element, said means for adjustably securing said tray element to said center support and retaining post including a latch arm on the under side of said tray element and notch means on said center support and retaining post, said latch arm being releasably engageable with said notch means for releasably securing said tray element in a plurality of different predetermined adjusted positions on said center support and retaining post.

2. In the highchair of claim 1, said means for securing said center support and retaining post to said seat portion removably securing said center support and retaining post to said seat portion.

3. In the highchair of claim 1, said latch arm including a forward handle portion which is moveable upwardly toward said tray element for disengaging said latch arm from said notch means.

4. In the highchair of claim 1, said seat and backrest portions being pivotable rearwardly as a unit on said frame means for pivoting said seat element to a reclined position.

5. In the highchair of claim 1, said armrest portions having upwardly facing upper support surfaces thereon, said tray element resting on said upper support surfaces and sliding thereon during adjustment of said tray element in forward and rearward directions.

6. In the highchair of claim 5, said armrest portions having outwardly extending retaining elements thereon, said tray element having a pair of hook elements thereon slid ably engaging said retaining elements for retaining said tray element in engagement on said upper support surfaces in a manner permitting adjustment of said tray element in forward and rearward directions.

7. A highchair comprising:

a seat element for receiving and supporting an infant or toddler in a seating position therein, said seat element including seat and backrest portions;

frame means for supporting said seat portion in upwardly spaced relation to a supporting surface, said frame means including a leg assembly, a carriage assembly slid ably mounted for upward and downward movement on said leg assembly and means for securing said carriage assembly in a plurality of different adjusted positions on said leg assembly, said carriage assembly including a pair of spaced, substantially parallel, upwardly and rearwardly extending right and left support arms and a transverse crossbar extending between said support arms; and means for securing said seat element on said carriage assembly such that said seat element is rearwardly pivotable as a unit about a pivot axis on said carriage assembly for pivoting said seat element from an upright position in which said seat element is operable for supporting an infant or toddler in a seating position to a reclined position in which said seat element is operable for supporting an infant or toddler in a reclined position, said means for securing said seat element including pivot means pivotally securing said support arms to opposite sides of said seat element and bracket means engageable with said crossbar for alternatively securing: said seat element in said upright position or said reclined position.

8. In the highchair of claim 7, said frame means including a pair of spaced upwardly and rearwardly extending right and left front legs and a pair of spaced upwardly and forwardly extending right and left rear legs, said rear legs and said front legs terminating in upper ends, said right and left front legs being pivotally joined to said right and left rear legs, respectively, at the upper ends thereof, said right and left support arms extending upwardly and rearwardly in substantially parallel relation to said right and left front legs, respectively.

9. In the highchair of claim 8, said support arms terminating in upper ends, said pivot means securing said seat element to said support arms adjacent the upper ends of said support arms.

10. A seat assembly comprising:

a seat element for receiving and supporting an infant or toddler in a seated position therein, said seat element including seat and backrest portions, said seat portion having a front extremity, and a pair of opposite side armrest portions extending upwardly along opposite sides of said seat portion; and a tray assembly removably and adjustably secured to said seat element, said tray assembly comprising a center support and retaining post having an upper end, means for securing said center support and retaining post to said seat portion adjacent the front extremity thereof at a location which is substantially equally spaced between said armrest portions, a tray element and means for adjustably securing said tray element to said center support and retaining post adjacent to the upper end thereof such that the position of said tray element is forwardly and rearwardly adjustable in substantially parallel upwardly spaced relation to said seat portion while said support and retaining post remains in substantially stationary relation to said seat element, said means for adjustably securing said tray element to said center support and retaining post including a latch arm on the under side of said tray element and notch means on said center support and retaining post, said latch arm being releasably engageable with said notch means for releasably securing said tray element in a plurality of different predetermined adjusted positions on said center support and retaining post.

11. In the seat assembly of claim 10, said means for securing said center support and retaining post to said seat portion removably securing said center support and retaining post to said seat portion.

12. The seat assembly of claim 10 and further comprising frame means for supporting said seat element, said seat and backrest portions being pivotable rearwardly as a unit on said frame means for pivoting said seat element to a reclined position.

13. In the seat assembly of claim 10, said latch arm including a forward handle portion which is moveable upwardly toward said tray element for disengaging said latch arm from said notch means.

14. In the seat assembly of claim 13, said arm rest portions having upwardly facing upper support surfaces thereon, said tray element resting on said upper support surfaces and sliding thereon during adjustment of said tray element in forward and rearward directions.

15. In the seat assembly of claim 14, said armrest portions having outwardly extending retaining elements thereon, said tray element having a pair of hook elements thereon slidably engaging said retaining elements for retaining said tray element in engagement on said upper support surfaces during adjustment of said tray element in forward and rearward directions.

16. A highchair comprising:

a seat element for receiving and supporting an infant or toddler in a seating position therein, said seat element including seat and backrest portions;

frame means for supporting said seat portion in upwardly spaced relation to a supporting surface, said frame means including a leg assembly having a pair of front legs and a pair of rear legs, a carriage assembly slidably mounted for upward and downward movement on said front legs and means for securing said carriage assembly in a plurality of different adjusted positions on said front legs; and means for securing said seat element on said carriage assembly such that said seat element is rearwardly pivotable as a unit about a pivot axis on said carriage assembly for pivoting said seat element from an upright position in which said seat element is operable for supporting an infant or toddler in a seating position to a reclined position in which said seat element is operable for supporting an infant or toddler in a reclined position.

* * * * *